US008647086B2

(12) United States Patent
Higuchi et al.

(10) Patent No.: US 8,647,086 B2
(45) Date of Patent: Feb. 11, 2014

(54) ENCLOSED COMPRESSOR

(75) Inventors: Masahide Higuchi, Kusatsu (JP); Yasutaka Ueno, Kusatsu (JP); Masanori Masuda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 897 days.

(21) Appl. No.: 12/669,821

(22) PCT Filed: Jul. 24, 2008

(86) PCT No.: PCT/JP2008/063260

§ 371 (c)(1),
(2), (4) Date: Jan. 20, 2010

(87) PCT Pub. No.: WO2009/014169

PCT Pub. Date: Jan. 29, 2009

(65) Prior Publication Data

US 2010/0196185 A1 Aug. 5, 2010

(30) Foreign Application Priority Data

Jul. 25, 2007 (JP) ..... 2007-193602
Jul. 17, 2008 (JP) ..... 2008-186485

(51) Int. Cl.
*F04C 29/00* (2006.01)
*F04B 39/12* (2006.01)

(52) U.S. Cl.
USPC ..... 418/59; 418/30; 418/60; 418/61.1

(58) Field of Classification Search
USPC ..... 418/59, 60, 61.1
See application file for complete search history.

(56) References Cited

U.S. PATENT DOCUMENTS

| | | | | |
|---|---|---|---|---|
| 4,250,423 | A * | 2/1981 | Linscott, Jr. | 310/216.124 |
| 4,605,362 | A * | 8/1986 | Sturgeon et al. | 418/63 |
| 4,971,529 | A * | 11/1990 | Gannaway et al. | 417/313 |
| 5,022,146 | A * | 6/1991 | Gannaway et al. | 29/888.02 |
| 6,447,274 | B1 * | 9/2002 | Horihata et al. | 418/60 |
| 6,631,617 | B1 * | 10/2003 | Dreiman et al. | 62/84 |
| 6,752,605 | B2 * | 6/2004 | Dreiman et al. | 418/5 |
| 6,892,454 | B2 * | 5/2005 | Matsumoto et al. | 29/888.025 |
| 6,929,455 | B2 * | 8/2005 | Dreiman et al. | 417/410.3 |
| 6,974,314 | B2 * | 12/2005 | Matsumoto et al. | 418/60 |
| 7,008,199 | B2 * | 3/2006 | Matsumoto et al. | 418/60 |
| 7,128,540 | B2 * | 10/2006 | Tadano et al. | 417/410.3 |
| 7,223,082 | B2 * | 5/2007 | Sato et al. | 418/11 |
| 7,252,487 | B2 * | 8/2007 | Sato | 418/60 |

(Continued)

FOREIGN PATENT DOCUMENTS

| | | |
|---|---|---|
| CN | 1548754 A | 11/2004 |
| CN | 1320279 C | 6/2007 |

(Continued)

OTHER PUBLICATIONS

Chinese Office Action of corresponding Chinese Application No. 200880100353.1 dated Mar. 23, 2011.

*Primary Examiner* — Kenneth Bomberg
*Assistant Examiner* — Dapinder Singh
(74) *Attorney, Agent, or Firm* — Global IP Counselors

(57) ABSTRACT

An enclosed compressor includes a compression element configured to compress a working fluid, a casing and a fixing member. The casing has a substantially cylindrical shell plate and houses the compression element. The fixing member is welded to the shell plate. The compression element is fixed to the fixing member by at least six fastening bolts.

12 Claims, 7 Drawing Sheets

(56) References Cited

U.S. PATENT DOCUMENTS

| | | | | |
|---|---|---|---|---|
| 7,290,994 | B2 * | 11/2007 | Kitaichi et al. | 418/60 |
| 7,361,005 | B2 * | 4/2008 | Sato | 418/60 |
| 7,462,021 | B2 * | 12/2008 | Ebara et al. | 418/60 |
| 7,473,081 | B2 * | 1/2009 | Ogasawara et al. | 418/1 |
| 7,500,836 | B2 * | 3/2009 | Shimizu et al. | 418/59 |
| 7,581,936 | B2 * | 9/2009 | Ogasawara et al. | 418/63 |
| 7,588,427 | B2 * | 9/2009 | Bae et al. | 418/32 |
| 7,604,466 | B2 * | 10/2009 | Dreiman et al. | 418/63 |
| 7,632,082 | B2 * | 12/2009 | Ogasawara et al. | 418/99 |
| 7,641,454 | B2 * | 1/2010 | Ueda et al. | 418/11 |
| 7,704,060 | B2 * | 4/2010 | Morimoto et al. | 418/11 |
| 7,753,663 | B2 * | 7/2010 | Shimizu et al. | 418/59 |
| 7,780,427 | B2 * | 8/2010 | Ueda et al. | 418/11 |
| 7,806,672 | B2 * | 10/2010 | Furusho et al. | 418/59 |
| 7,837,449 | B2 * | 11/2010 | Tadano et al. | 417/410.3 |
| 7,854,602 | B2 * | 12/2010 | Bae et al. | 418/32 |
| 7,871,252 | B2 * | 1/2011 | Bae et al. | 418/32 |
| 7,891,956 | B2 * | 2/2011 | Bae et al. | 417/217 |
| 7,891,961 | B2 * | 2/2011 | Shimizu et al. | 418/55.1 |
| 2001/0002981 | A1 * | 6/2001 | Gannaway | 418/60 |
| 2003/0017070 | A1 | 1/2003 | Moroi et al. | |
| 2003/0115900 | A1 * | 6/2003 | Matsumoto et al. | 62/278 |
| 2004/0219037 | A1 | 11/2004 | Higuchi et al. | |
| 2006/0188382 | A1 * | 8/2006 | Shimizu et al. | 418/62 |

FOREIGN PATENT DOCUMENTS

| | | | |
|---|---|---|---|
| JP | 02-227591 | A | 9/1990 |
| JP | 2003-035261 | A | 2/2003 |
| JP | 2003-262192 | A | 9/2003 |

* cited by examiner

ENCLOSED COMPRESSOR

CROSS-REFERENCE TO RELATED APPLICATIONS

This U.S. National stage application claims priority under 35 U.S.C. §119(a) to Japanese Patent Application Nos. 2007-193602, filed in Japan on Jul. 25, 2007, and 2008-186485, filed in Japan on Jul. 17, 2008, the entire contents of which are hereby incorporated herein by reference.

TECHNICAL FIELD

The present invention relates to an enclosed compressor and particularly to an enclosed compressor having a structure where a compression element is fixed to a fixing member and where the fixing member is welded and fixed to a shell plate of a casing.

BACKGROUND ART

In an enclosed compressor where a compression element is housed in a casing, with respect to the problem that the joint strength between the casing and the compression element is insufficient, sometimes, as described in Japanese Patent Publication No. 2003-262192, there is employed a structure where a front head that configures the compression element is fixed to a fixing member called a mounting plate that is made of steel and where the mounting plate is welded and fixed to a shell plate of the casing. Here, the front head is fastened and fixed by three fastening bolts to the mounting plate. Further, the mounting plate is disposed so as to surmount the front head from below, and the three fastening bolts are screwed from below the mounting plate.

SUMMARY

In the enclosed compressor of the conventional structure described above, there arises a phenomenon where, as will be understood from measurement data showing the relationship between the operating speed and the frequency characteristic of the operating sound in FIG. 6, the operating sound in the frequency band around 1000 to 2000 Hz becomes high despite the operating speed (see portion A in FIG. 6); as a result, there arises the problem that the noise level in this frequency band is high even when the outer periphery of the casing is covered by a soundproofing material.

It is an object of the present invention to reduce noise in an enclosed compressor having a structure where a compression element is fixed to a fixing member and where the fixing member is welded and fixed to a shell plate of a casing.

An enclosed compressor pertaining to a first aspect of the present invention comprises: a compression element that compresses a working fluid; a casing that has a substantially cylindrical shell plate and houses the compression element; and a fixing member to which the compression element is fixed and which is fixed by welding to the shell plate, wherein fixing of the compression element and the fixing member is performed as a result of the compression element and the fixing member being fastened together by six or more fastening bolts.

The inventors of the present invention conducted extensive research in regard to the phenomenon where the operating sound in the frequency band around 1000 to 2000 Hz in the enclosed compressor of the conventional structure described above becomes high and discovered that this phenomenon is attributed to the natural frequency of the assembly of the compression element and the fixing member including the casing.

Thus, the inventors raise the holding strength of bolt fastening of the compression element and the fixing member by performing fixing of the compression element and the fixing member by six or more fastening bolts as in the enclosed compressor pertaining to the present invention and thus raise the rigidity of the assembly of the compression element and the fixing member including the casing. Thus, the operating sound attributed to the natural frequency of this assembly shifts to a higher frequency band than around 2000 Hz, and the operating sound in the frequency band around 1000 to 2000 Hz decreases, so it becomes easier to obtain a soundproofing effect resulting from the soundproofing material that covers the outer periphery of the casing, and noise can be reduced.

An enclosed compressor pertaining to a second aspect of the present invention is the enclosed compressor pertaining to the first aspect of the present invention, wherein the fixing member contacts an inner peripheral surface of the shell plate and is welded at plural welding portions that are juxtaposed in a circumferential direction of the shell plate, the fastening bolts are juxtaposed in the circumferential direction on an inner peripheral side of the shell plate, and a circumferential direction position of each of the welding portions substantially coincides with a circumferential direction position of any of the fastening bolts.

In the enclosed compressor of the conventional structure described above, no special consideration was given in regard to the circumferential direction positions of the welding portions that are portions where the fixing member is welded to the shell plate of the casing.

However, the inventors of the present invention focused on raising the rigidity of the assembly of the compression element and the fixing member including the casing and further discovered that the circumferential direction positions of the welding portions affect the rigidity of the assembly of the compression element and the fixing member including the casing.

Thus, the inventors ensure that the distance between the welding portions and the fastening bolts becomes as short as possible by causing the circumferential direction position of each welding portion to substantially coincide with the circumferential direction position of any of the fastening bolts that are juxtaposed in the circumferential direction on the inner peripheral side of the shell plate as in the enclosed compressor pertaining to the present invention and thus further raise the rigidity of the assembly of the compression element and the fixing member including the casing. Thus, the operating sound attributed to the natural frequency of this assembly shifts to an even higher frequency band, and the operating sound in the frequency band around 1000 to 2000 Hz further decreases, so noise can be reduced even more.

An enclosed compressor pertaining to a third aspect of the present invention is the enclosed compressor pertaining to the second aspect of the present invention, wherein the fastening bolts are disposed substantially equidistantly in the circumferential direction of the shell plate.

In the enclosed compressor of the conventional structure described above, no special consideration was given in regard to the circumferential direction positions of the fastening bolts.

However, the inventors of the present invention focused on raising the rigidity of the assembly of the compression element and the fixing member including the casing and further discovered that the circumferential direction positions of the fastening bolts affect the rigidity of the assembly of the compression element and the fixing member including the casing.

Thus, the inventors can reliably obtain the effect of raising rigidity because the rigidity of the assembly of the compression element and the fixing member including the casing becomes equalized in the circumferential direction by disposing the fastening bolts substantially equidistantly in the circumferential direction of the shell plate as in the enclosed compressor pertaining to the present invention.

An enclosed compressor pertaining to a fourth aspect of the present invention is the enclosed compressor pertaining to any of the first to third aspects of the present invention, wherein the compression element has a cylinder that is configured as a result of a first cover body, a cylinder body and a second cover body being juxtaposed in an axial direction of the shell plate, and the fixing member is disposed so as to surmount the cylinder from the axial direction first cover body side and is fixed to the first cover body by screwing the fastening bolts from the axial direction fixing member side.

When employing a structure where the cylinder of the compression mechanism is configured as a result of a first cover body (e.g., the front head in the enclosed compressor of the conventional structure), a cylinder body and a second cover body (e.g., a rear head in the enclosed compressor of the conventional structure) being juxtaposed in the axial direction of the shell plate, when employing a structure where, as in the enclosed compressor of the conventional structure, the fixing member is disposed so as to surmount the first cover body from the axial direction cylinder body side and where fastening bolts are screwed from the axial direction cylinder body side to fix the fixing member to the first cover body, there arises the need to avoid interference between head portions of the fastening bolts and the cylinder body (e.g., a portion in which an intake passage and a bush hole are formed).

Here, if the number of the fastening bolts is three, it is possible to avoid interference with the cylinder body, but when the number of the fastening bolts becomes six or more as in the enclosed compressor pertaining to the present invention, it becomes difficult to avoid interference between the head portions of the fastening bolts and the cylinder body, and thus it becomes difficult to make the number of the fastening bolts six or more. In particular, it becomes extremely difficult to dispose the fastening bolts substantially equidistantly in the circumferential direction of the shell plate as in the enclosed compressor pertaining to the third aspect of the invention.

Thus, the inventors ensure that it becomes easy to avoid interference between the head portions of the fastening bolts and the cylinder body even if the number of the fastening bolts increases by employing a structure where the fixing member is fixed to the first cover body by disposing the fixing member so as to surmount the cylinder from the axial direction first cover body side and screwing the fastening bolts from the axial direction fixing member side. Thus, when employing a structure where the cylinder of the compression element is configured as a result of the first cover body, the cylinder body and the second cover body being juxtaposed in the axial direction of the shell plate, the compression element and the fixing member can be fastened and fixed together by the six or more fastening bolts as in the enclosed compressor pertaining to the present invention.

An enclosed compressor pertaining to a fifth aspect of the present invention is the enclosed compressor pertaining to any of the first to fourth aspects of the present invention, wherein an inner diameter of the shell plate is 125 mm or more.

In an enclosed compressor having a structure where the compression element is fixed to the fixing member and where the fixing member is welded and fixed to the shell plate of the casing, in the case of a large casing where the inner diameter of the shell plate is 125 mm or more, there is a tendency for the noise level to become large in comparison to a small casing.

However, in the enclosed compressor pertaining to the present invention, noise can be reduced by employing any of the first to fourth aspects of the present invention, so the tendency for the noise level to become large as a result of enlarging the inner diameter of the shell plate can also be controlled.

An enclosed compressor pertaining to a sixth aspect of the present invention is the enclosed compressor pertaining to any of the first to fifth aspects of the present invention, wherein the working fluid is carbon dioxide.

When carbon dioxide is used as the working fluid, it becomes easier for the compression element to be vibrated by a pressure load and there is a tendency for the noise level to become large in comparison to when a HFC (hydrofluorocarbon) refrigerant or the like is used.

However, in the enclosed compressor pertaining to the present invention, noise can be reduced by employing any of the first to fifth aspects of the present invention, so the tendency for the noise level to become large as a result of using carbon dioxide as the working fluid can also be controlled.

DETAILED DESCRIPTION OF EMBODIMENT(S)

An embodiment of an enclosed compressor pertaining to the present invention will be described below on the basis of the drawings.

(1) Configuration of Enclosed Compressor

Figure 1:
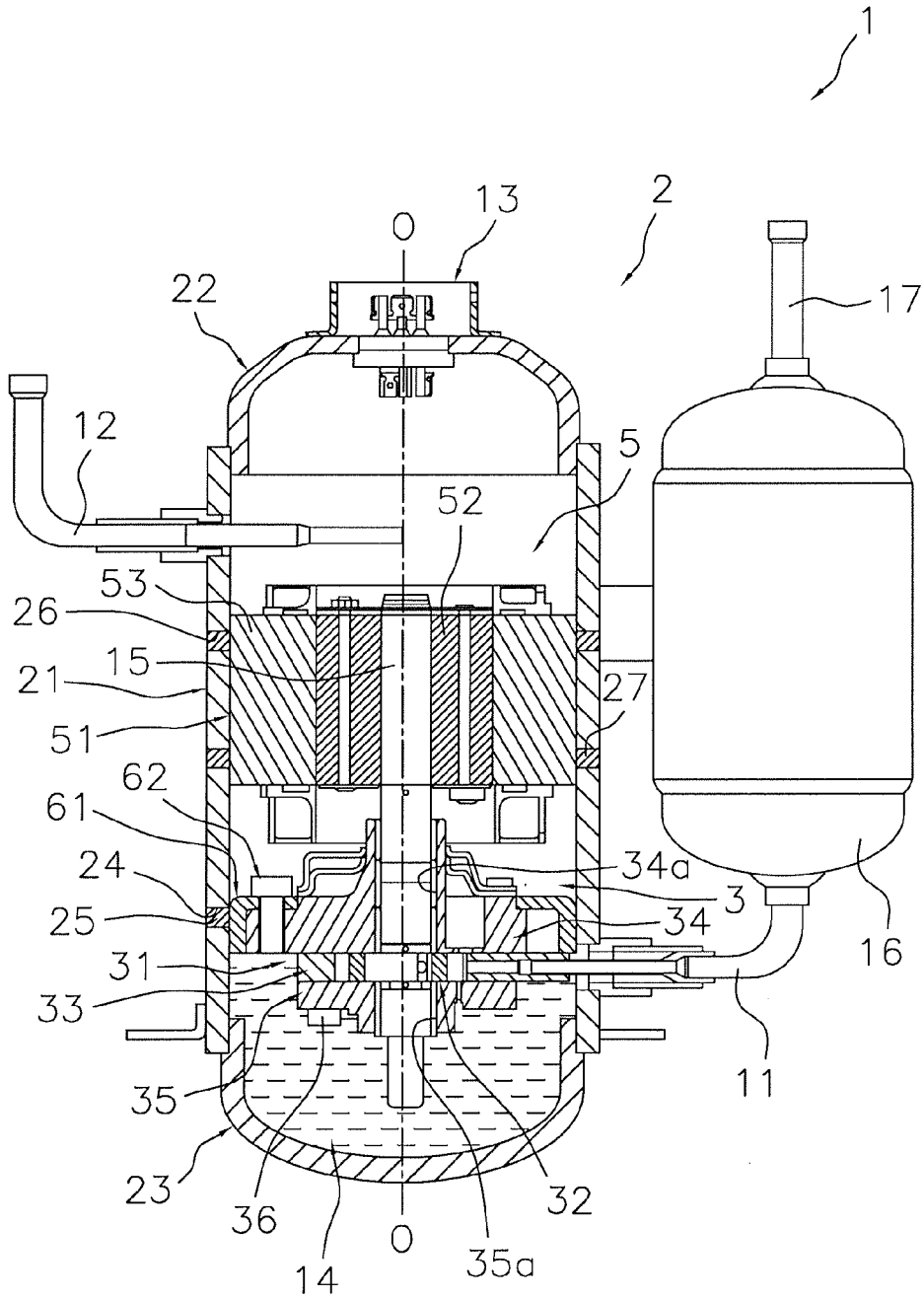
FIG. 1 is a general longitudinal sectional view of an enclosed compressor pertaining to an embodiment of the present invention.
Figure 2:
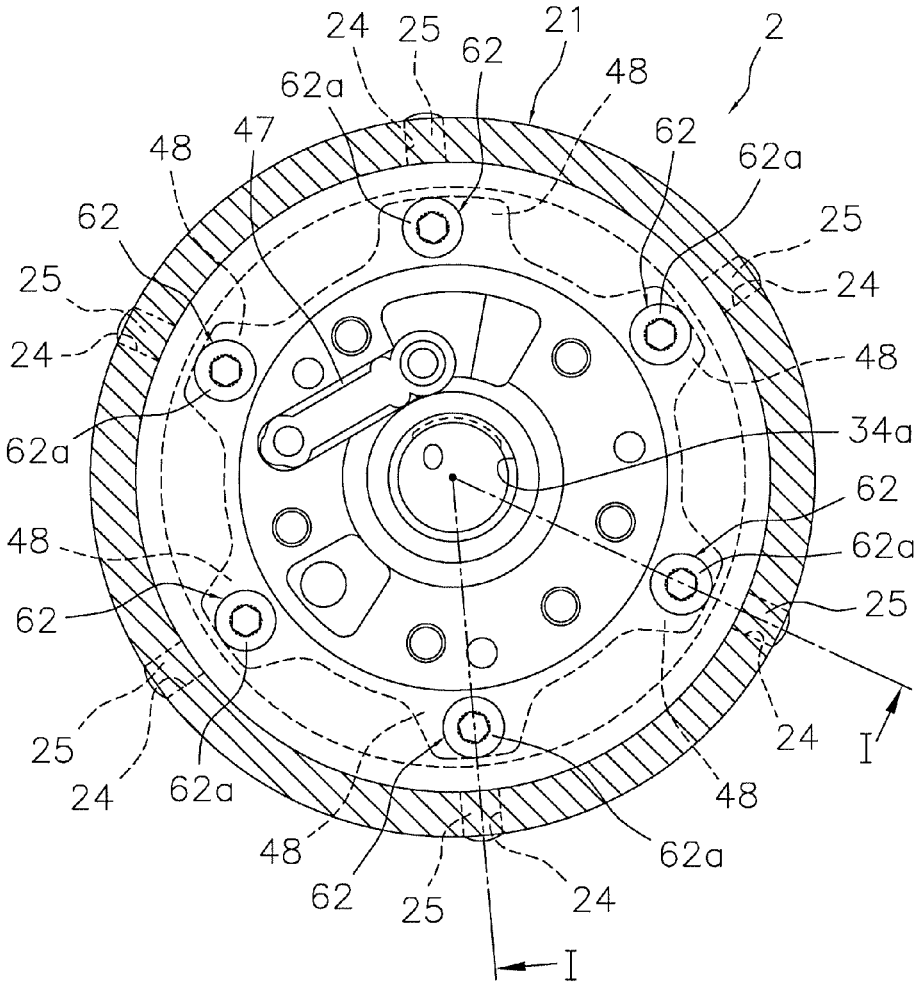
FIG. 2 is a general plan view showing the configurations of a front head and a mounting plate including the cross section of a shell plate of a casing.
Figure 3:
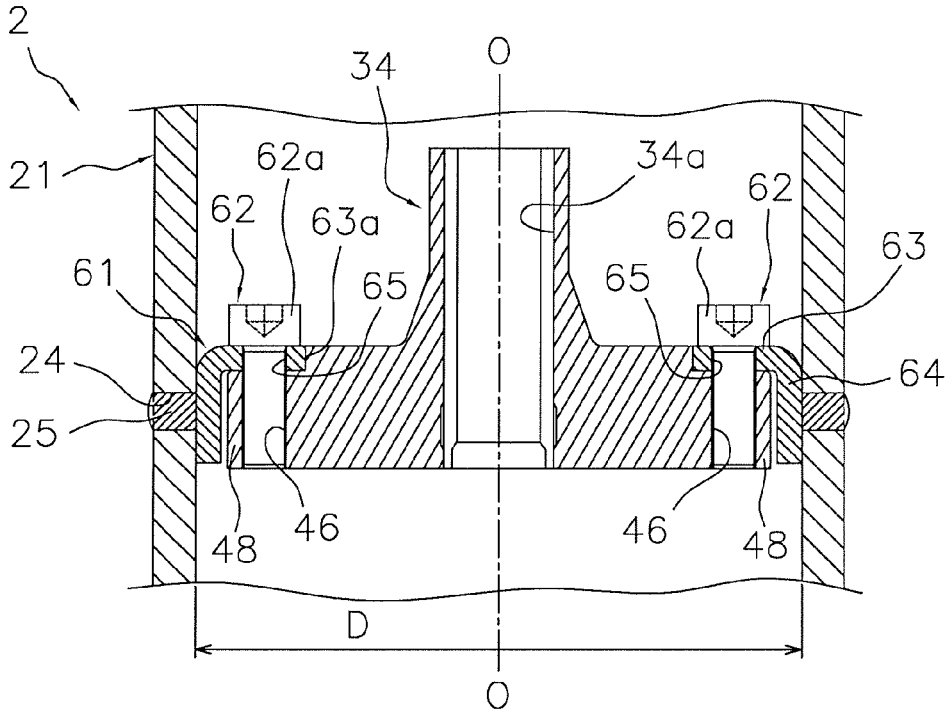
FIG. 3 is a cross-sectional view along I-I of FIG. 2.
Figure 4:
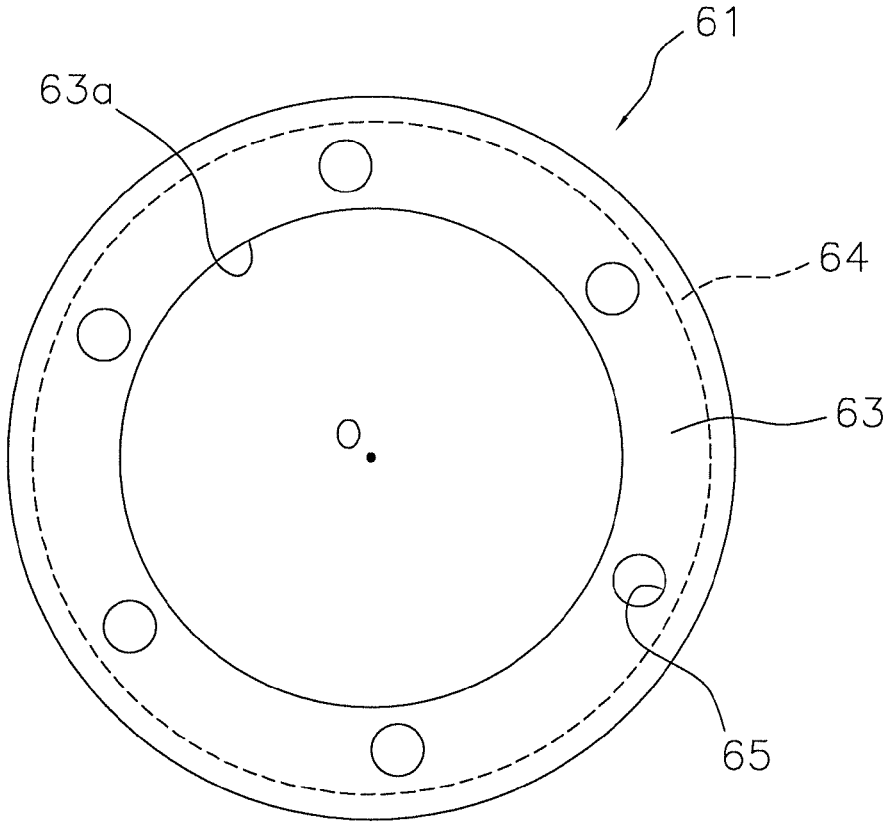
FIG. 4 is a general plan view showing the configuration of the mounting plate.
Figure 5:
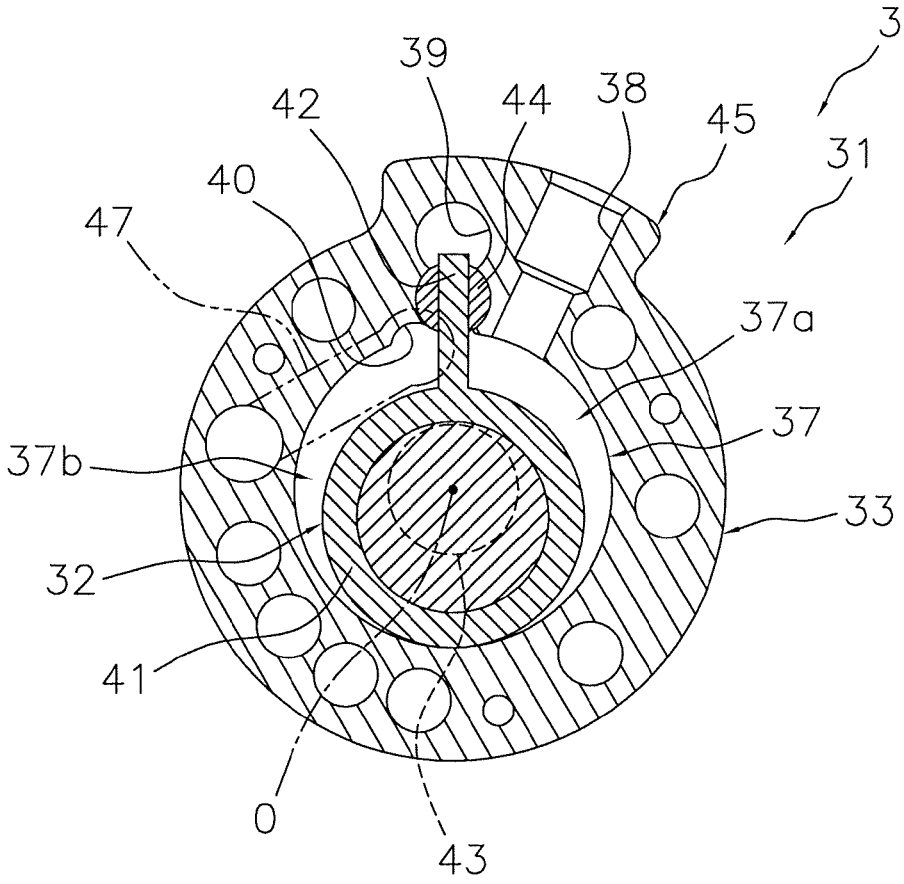
FIG. 5 is a general plan sectional view showing the configurations of a cylinder body and a swing.

FIG. 1 is a general longitudinal sectional view of an enclosed compressor 1 pertaining to an embodiment of the present invention. FIG. 2 is a general plan view showing the configurations of a front head 34 and a mounting plate 61 including the cross section of a shell plate 21 of a casing 2. FIG. 3 is a cross-sectional view along I-I of FIG. 2. FIG. 4 is a general plan view showing the configuration of the mounting plate 61. FIG. 5 is a general plan sectional view showing the configurations of a cylinder body 33 and a swing 32. It will be noted that, in the description below, the direction of an axis-of-rotation line O-O of a compressor motor 5 will be referred to as an "axial direction", the direction perpendicular to the axis-of-rotation line O-O will be referred to as a "radial direction" and the direction around the axis-of-rotation line O-O will be referred to as a "circumferential direction". Further, the vertical direction of the shell plate 21, the radial direction of the shell plate 21 and the direction around the shell plate 21 will be referred to respectively as the "axial direction", the "radial direction" and the "circumferential direction" in accordance with the direction of the axis-of-rotation line O-O.

The enclosed compressor 1 is a swinging piston type rotary compressor that is connected to a refrigerant circuit performing refrigeration cycle operation in an air conditioner or the like and which has the function of compressing refrigerant serving as a working fluid, and the enclosed compressor 1 mainly has a casing 2, a compression element 3 and a compressor motor 5. Additionally, the enclosed compressor 1 has an enclosed structure where the compression element 3 and the compressor motor 5 are housed inside the casing 2 and moreover has a structure (a so-called high-pressure dome type structure) where the space inside the casing 2 is filled with high-pressure refrigerant after the refrigerant has been compressed by the compression element 3. Further, carbon dioxide ($CO_2$), for example, is used as the refrigerant, and for this reason, the casing 2 is configured such that it can handle high pressure (about 14 MPa) in refrigeration cycle operation using carbon dioxide as the refrigerant.

In the present embodiment, the casing 2 is an upright cylindrical container and mainly has a substantially cylindrical shell plate 21 and a substantially bowl-shaped top end plate 22 and a substantially bowl-shaped bottom end plate 23 that close the top and bottom open ends of the shell plate 21. In the shell plate 21, there are disposed an intake pipe 11 that penetrates the lower portion of the shell plate 21 and a discharge pipe 12 that penetrates the shell plate 21. The discharge pipe 12 penetrates a higher portion of the shell plate 21 than the position where the intake pipe 11 penetrates the shell plate 21, and the discharge pipe 12 allows the space inside the casing 2 to be communicated with the outside. Additionally, the top end of the discharge pipe 12 is configured to be connectable to an unillustrated refrigerant pipe that configures the refrigerant circuit. In the top end plate 22, there is disposed a terminal 13 that is connected to an external power source and supplies electrical power to the compressor motor 5. Further, in the lower portion of the casing 2, there is formed an oil reservoir portion 14 in which refrigerating machine oil is stored. Additionally, polyalkylene glycol or the like, which has a high-viscosity characteristic, is used as the refrigerant machine oil considering that carbon dioxide is used as the refrigerant. It will be noted that, although it is not shown here, the outer periphery of the casing 2 is covered by a soundproofing material in order to keep the operating sound of the enclosed compressor 1 from spreading to the outside. As this soundproofing material, there is used mainly a soundproofing material that has a noise absorbing material comprising glass wool, rock wool, resin fiber, or the like.

The compression element 3 mainly has a cylinder 31 and a swing 32 serving as a swinging piston that swings inside the cylinder 31, and the compression element 3 is disposed in the lower portion of the inside of the casing 2. The cylinder 31 mainly has a cylinder body 33, a front head 34 serving as a first cover body and a rear head 35 serving as a second cover body. The cylinder body 33 is formed in a substantially cylindrical shape and is disposed concentrically with the shell plate 21 of the casing 2. The front head 34, the cylinder body 33 and the rear head 35 are juxtaposed in the axial direction of the shell plate 21 as a result of the front head 34 being disposed on the top side of the cylinder body 33 and the rear head 35 being disposed on the bottom side of the cylinder body 33 and are fastened together by a fastening bolt 36 and integrally assembled. Here, the front head 34, the cylinder body 33 and the rear head 35 are made of castings. The cylinder 31 is fixed to the shell plate 21 of the casing 2 via a mounting plate 61 serving as a fixing member. Specifically, the mounting plate 61 is fastened and fixed to the front head 34 by fastening bolts 62 and is fixed to the shell plate 21 of the casing 2 by welding. Here, welding portions 25 are formed by causing molten metal to flow in from the outside of the casing 2 through welding holes 24 that penetrate the shell plate 21 of the casing 2, and the mounting plate 61 and the shell plate 21 of the casing 2 are welded and fixed together at these welding portions 25. Further, in the cylinder 31, a compression chamber 37 is sectioned and formed by the inner peripheral surface of the cylinder body 33, the bottom end surface of the front head 34, the top end surface of the rear head 35 and the outer peripheral surface of the swing 32. In the front head 34 and in the rear head 35, there are formed shaft holes 34*a* and 35*a* that vertically penetrate the centers of the front head 34 and the rear head 35, and a drive shaft 15 is fitted into these shaft holes 34*a* and 35*a* such that the drive shaft 15 may freely rotate. That is, the drive shaft 15 is disposed so as to extend through the center of the inside of the casing 2 in the vertical direction and penetrates the front head 34, the compression chamber 37 and the rear head 35 of the cylinder 31 in the vertical direction. It will be noted that the details of the compression element 3 and the mounting plate 61 including the shell plate 21 will be described later.

The compression motor 5 has a stator 51 and a rotor 52 and is disposed above the compression element 3. The stator 51 is equipped with a cylindrical stator core 53 and 3-phase coils that are attached to the stator core 53. Additionally, the stator 51 is configured to generate a rotating magnetic field by conducting electricity to each coil. An unillustrated permanent magnet is fitted inside the rotor 52, the rotor 52 is configured such that it is rotatable on the inner side of the stator 51, and the drive shaft 15 is fitted into the rotor 52 such that the rotor 52 is drivingly coupled to the compression element 3. The stator core 53 is shrink-fitted to the shell plate 21 of the casing 21 and is fixed to the shell plate 21 by welding. Here, welding portions 27 are formed by causing molten metal to flow in from the outside of the casing 2 through welding holes 26 that penetrate the shell plate 21 of the casing 2, and the stator core 53 and the shell plate 21 of the casing 2 are welded and fixed together at these welding portions 27. Additionally, the rotor 52 rotates as a result of electricity being conducted to the compressor motor 5 via the terminal 13, the drive shaft 15 rotates because of the rotation of the rotor 52, and rotational driving force is applied to the compression element 3 to drive the compression element 3.

It will be noted that the drive shaft 15 is disposed with a centrifugal pump and an oil feed path that are not shown. The centrifugal pump is disposed on the bottom end portion of the drive shaft 15 and is configured to pump up the refrigerating machine oil stored in the oil reservoir portion 14 in accompaniment with the rotation of the drive shaft 15. Additionally, the oil feed path extends inside the drive shaft 15 in the vertical direction and is configured to supply, to each sliding portion, the refrigerating machine oil that the centrifugal pump has pumped up.

Further, an intake muffler 16 is connected via the intake pipe 11 to the enclosed compressor 1. In the present embodiment, this intake muffler 16 is an upright cylindrical closed container, with the intake pipe 11 being inserted into its bottom end and with the bottom end of a return pipe 17 being inserted into its top end. The return pipe 17 is for guiding the refrigerant circulating through the refrigerant circuit to the intake muffler 16 and is configured such that its top end is connectable to an unillustrated refrigerant pipe that configures the refrigerant circuit. The intake muffler 16 is configured such that it can control pressure pulsation of the refrigerant flowing in through the return pipe 17 and reduce the operating sound.

Next, the configurations of the swing 32 and the cylinder body 33 that configure the compression element 3 will be described in detail. The swing 32 is disposed on the inner side of the cylinder body 33, and an intake passage 38, a bush hole 39 and a discharge passage 40 are formed in the cylinder body 33. The swing 32 is configured as a result of a cylindrical rotor portion 41 and a cuboid blade portion 42 being integrally formed, and the swing 32 is disposed such that the rotor portion 41 is positioned in the compression chamber 37. An eccentric portion 43 integrally formed with the drive shaft 15 is fitted in the rotor portion 41, the rotor portion 41 is supported such that it may freely rotate on the eccentric portion 43, and the rotor portion 41 is disposed such that part of its outer peripheral surface contacts the inner peripheral surface of the cylinder body 33 via an oil film of the refrigerating machine oil. Additionally, the compression chamber 37 is sectioned by the swing 32 into a low pressure chamber 37*a* and a high pressure chamber 37*b*. The intake passage 38 is formed so as to penetrate the outer peripheral surface and the inner peripheral surface of the cylinder body 33 in the radial direction. Additionally, the intake passage 38 is configured such that its inner side end opens to the compression chamber 37 and is communicable with the low pressure chamber 37*a*. The intake pipe 11 fitted into the shell plate 21 of the casing 2 is fitted into the intake passage 38. The bush hole 39 is disposed as a recess in the inner peripheral surface of the cylinder body 33 near the intake passage 38 and is formed from the top end surface to the bottom end surface of the cylinder body 33. A pair of bushes 44 whose cross sections have a substantially semicircular columnar shape are disposed such that they may freely swing in the bush hole 39. These bushes 44 are disposed near the inner peripheral surface of the cylinder body 33 in the bush hole 39, and the outer peripheral end portion of the blade portion 42 is disposed in a portion on the outer peripheral side of the bushes 44 in the bush hole 39. The blade portion 42 of the swing 32 is inserted between both bushes 44, and this blade portion 42 is supported by both bushes 44 such that it may freely move back and forth. Additionally, when the drive shaft 15 rotates, the swing 32 swings using, as a swinging center, both bushes 44 that swing. The discharge passage 40 is formed by cutting a semicircular notch in part of the inner surface of the cylinder body 33 in a position where the bush hole 39 is sandwiched in the circumferential direction between the discharge passage 40 and the intake passage 38. It will be noted that, although the cylinder body 33 is generally a substantially annular member that is smaller than the inner diameter of the shell plate 21 of the casing 2, the portion in which the intake passage 38 and the bush hole 39 are formed configures a radial direction projecting portion 45 that projects outward in the radial direction as far as near the inner peripheral surface of the shell plate 21.

Next, the mounting plate 61 will be described in detail. The mounting plate 61 has a circular top surface portion 63 and a side surface portion 64 that extends downward from the outer peripheral edge of the top surface portion 63, such that the mounting plate 61 is formed in a U-shape in profile. Additionally, the mounting plate 61 is disposed so as to surmount the cylinder 31 from above (that is, the axial direction front head 34 side), and the front head 34 of the compression element 3 is fitted into the mounting plate 61 so as to block an opening 63*a* on the inner peripheral side of the top surface portion 63. In the present embodiment, this front head 34 is disposed such that its top end surface becomes substantially even with the top end surface of the top surface portion 63 of the mounting plate 61. The mounting plate 61 comprises steel whose carbon content is 2.0% or less by mass percentage, and the side surface portion 64 thereof is fixed by welding to the shell plate 21 of the casing 2. More specifically, the side surface portion 64 of the mounting plate 61 contacts the inner peripheral surface of the shell plate 21 and is welded at the six welding portions 25 (that is, portions formed by causing molten metal to flow in from the outside of the casing 2 through the six welding holes 24 that penetrate the shell plate 21) that are juxtaposed in the circumferential direction of the shell plate 21. Further, six through holes 65 for inserting the fastening bolts 62 that become fastened to the front head 34 are formed in the top surface portion 63 of the mounting plate 61. More specifically, the six through holes 65 are juxtaposed in the circumferential direction on the inner peripheral side of the shell plate 21, and each through hole 65 is disposed substantially equidistantly in the circumferential direction (that is, in the case of the present embodiment, such that an angle formed by a line connecting the circumferential direction center of a given through hole 65 and an axial center O and a line connecting the circumferential direction center of the adjacent through hole 65 in the circumferential direction and the axial center O becomes about 60 degrees). Additionally, the mounting plate 61 is fixed to the front head 34 by screwing the six fastening bolts 62 from above (that is, the axial direction mounting plate 61 side). Here, head portions 62*a* of the fastening bolts 62 project further upward than the top end surface of the top surface portion 63 of the mounting plate 61. Further, the welding portions 25 are, like the fastening bolts 62, disposed substantially equidistantly in the circumferential direction, and the circumferential direction position of each welding portion 25 substantially coincides with the circumferential direction position of any of the fastening bolts 62.

Next, the front head 34 will be described in detail. Six fastening holes 46 and a notch recess portion 47 are formed in the front head 34. The fastening holes 46 are holes for screwing the fastening bolts 62 for fastening and fixing the front head 34 to the mounting plate 61, and the fastening holes 46 are formed in positions corresponding to the through holes 65 in the mounting plate 61. More specifically, six radial direction projecting portions 48 that project as far as near the inner peripheral surface of the side surface portion 64 of the mounting plate 61 are formed on the outer peripheral edge of the front head 34 so as to correspond to the through holes 65 in the mounting plate 61, and the fastening holes 46 are formed facing downward (the axial direction cylinder 33 side) from the top end surface of each radial direction projecting portion 48. The notch recess portion 47 is formed in a substantially oval shape when seen in a plan view in the top surface of the front head 34. Further, the notch recess portion 47 is communicated with the discharge passage 40 and can allow the high-pressure refrigerant inside the compression chamber 37 to be discharged into the inside of the casing 2.

(2) Characteristics of Enclosed Compressor

The enclosed compressor 1 of the present embodiment has the following characteristics.

(A)

Figure 6:
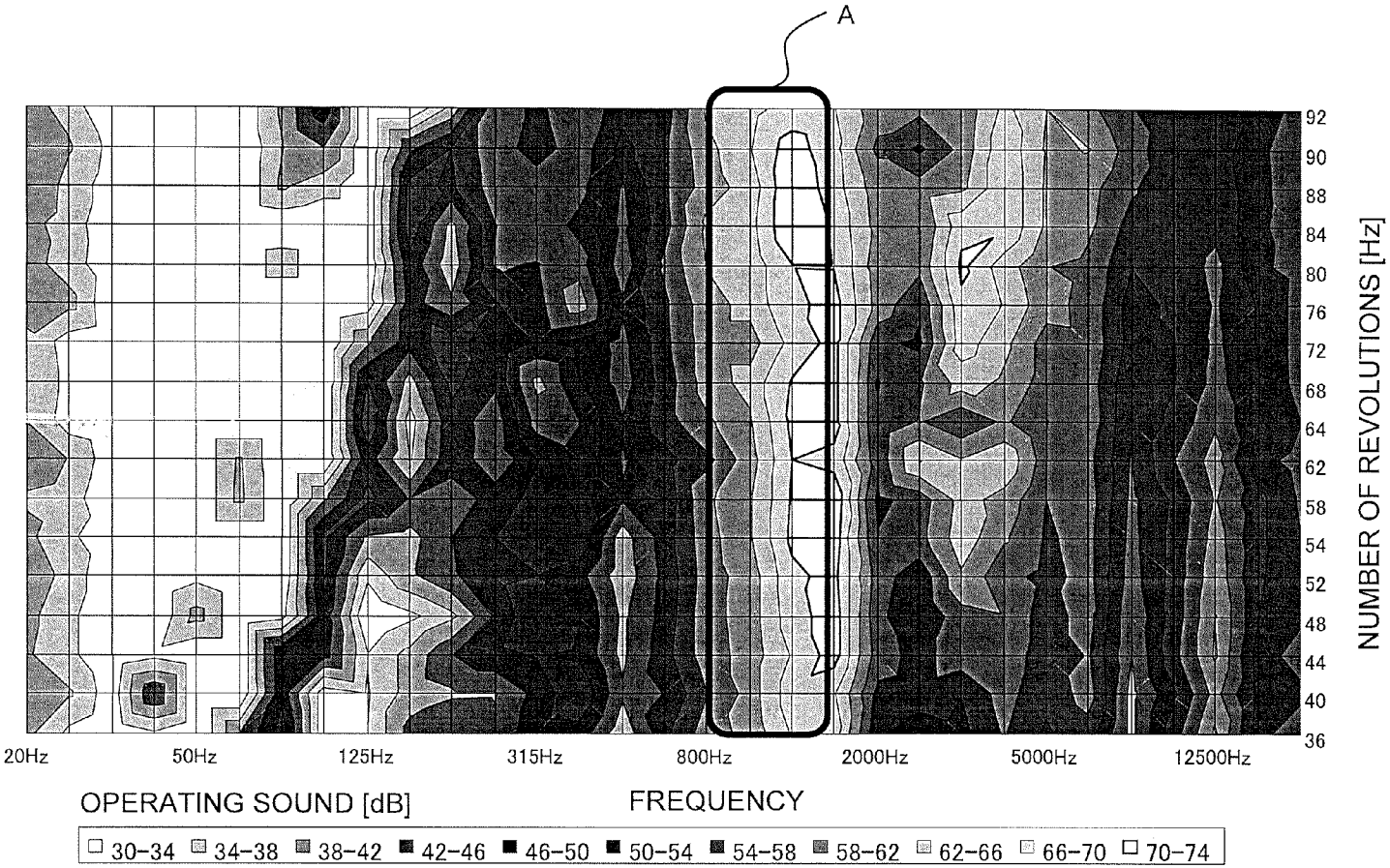
(Prior Art) FIG. 6
FIG. 6 is measurement data showing the relationship between the operating speed and the frequency characteristic of the operating sound in an enclosed compressor of a conventional structure.

The inventors of the enclosed compressor 1 of the present embodiment conducted extensive research in regard to the phenomenon where the operating sound in the frequency band around 1000 to 2000 Hz in the enclosed compressor of the conventional structure becomes high (see FIG. 6) and discovered that this phenomenon is attributed to the natural frequency of the assembly of the compression element and the fixing member including the casing.

Figure 7:
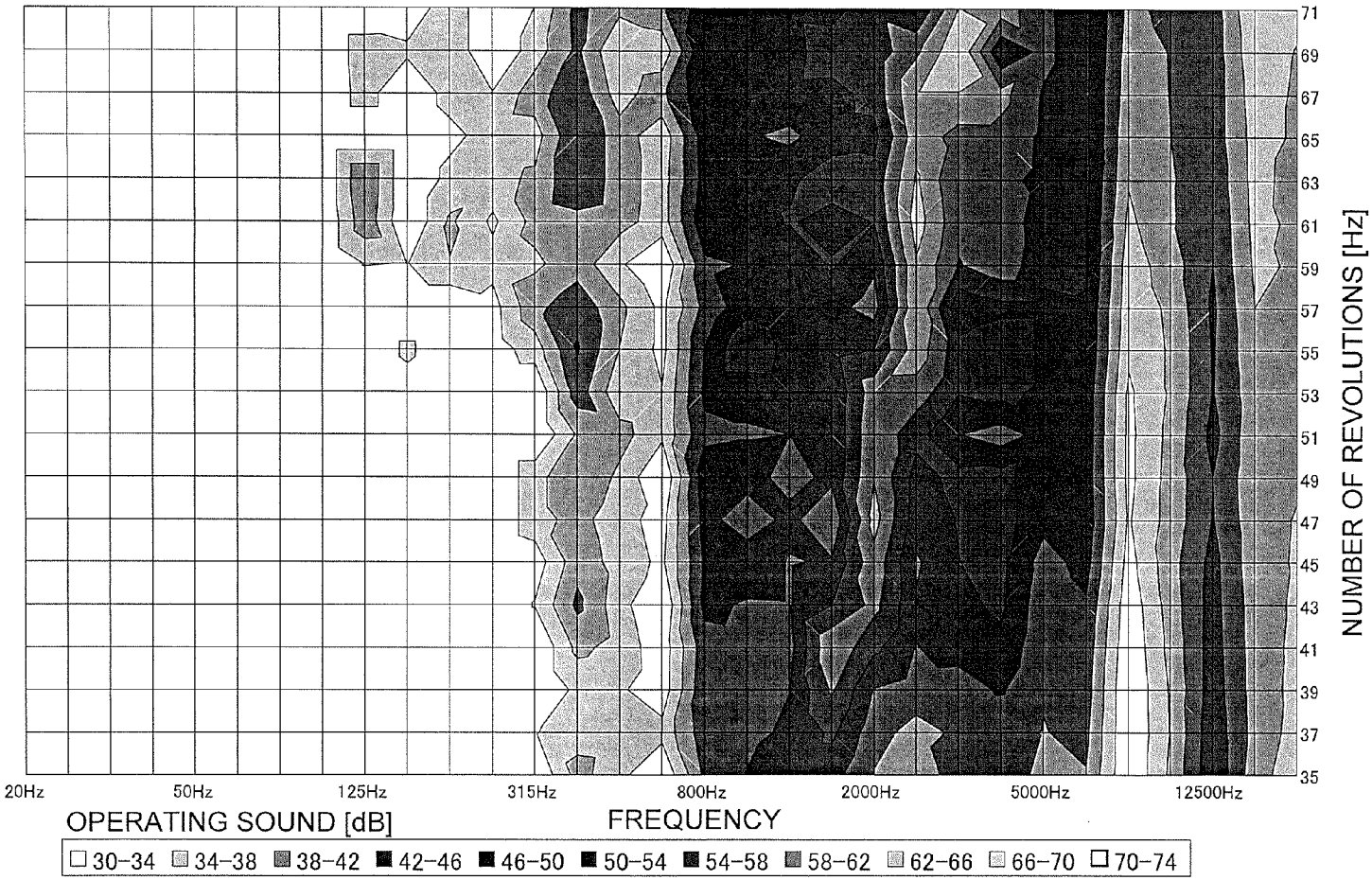
FIG. 7 is measurement data showing the relationship between the operating speed and the frequency characteristic of the operating sound in the enclosed compressor of the structure of the present invention.

Thus, the inventors raise the holding strength of bolt fastening of the compression element 3 and the mounting plate 61 by performing fixing of the compression element 3 (specifically, the front head 34) and the mounting plate 61 serving as the fixing member by fastening together the compression element 3 and the mounting plate 61 by the six fastening bolts 62 (see FIG. 2) as in the enclosed compressor 1 pertaining to the present embodiment and thus raise the rigidity of the assembly of the compression element 3 and the mounting plate 61 including the casing 2. Thus, the operating sound attributed to the natural frequency of this assembly shifts to a higher frequency band than around 2000 Hz, and the operating sound in the frequency band around 1000 to 2000 Hz decreases, so it becomes easier to obtain a soundproofing effect resulting from the soundproofing material that covers the outer periphery of the casing 2, and noise can be reduced. More specifically, the sound absorbing material that configures the soundproofing material has, depending on the material and the like of the sound absorbing material, a sound absorption characteristic where its sound absorption coefficient of operating sound in a low frequency band of 1000 to 2000 Hz or less is low and where its sound absorption coefficient of operating sound in a high frequency band of 2000 Hz or more is high, but in the enclosed compressor 1 pertaining to the present embodiment, as described above, it becomes possible to reduce noise while considering the sound absorption characteristic of the soundproofing material by shifting the operating sound to a high frequency band, so it becomes possible to use a relatively inexpensive soundproofing material and reduce noise without having to administer to the soundproofing material some kind of special contrivance such as using a soundproofing material that has a sound absorbing material whose sound absorption coefficient of operating sound in a low frequency band is high. Here, FIG. 7 shows measurement data showing the relationship between the operating speed and the frequency characteristic of the operating sound in the enclosed compressor 1 of the present embodiment, and it will be understood that the peak of the operating sound attributed to the natural frequency of the assembly of the compression element 3 and the mounting plate 61 including the casing 2 shifts from around 1500 Hz (see FIG. 6) to around 2500 Hz and that the operating sound in the frequency band around 1000 to 2000 Hz decreases to from around 70 dB (see FIG. 6) to around 50 dB.

It will be noted that, from the standpoint of the action that raises the holding strength of bolt fastening of the compression element 3 and the mounting plate 61, the number of the fastening bolts 62 is not limited to six as in the present embodiment but may also be increased to more than six, such as seven or eight, for example.

(B)

Further, in the enclosed compressor of the conventional structure, no special consideration was given in regard to the circumferential direction positions of the welding portions 25 that are portions where the fixing member is welded to the shell plate of the casing, but the inventors of the enclosed compressor 1 of the present embodiment focused on raising the rigidity of the assembly of the compression element 3 and the fixing member including the casing and further discovered that the circumferential direction positions of the welding portions affect the rigidity of the assembly of the compression element and the fixing member including the casing.

Thus, the inventors ensure that the distance between the welding portions 25 and the fastening bolts 62 becomes as short as possible by causing the circumferential direction position of each welding portion 25 to substantially coincide with the circumferential direction position of any of the fastening bolts 62 that are juxtaposed in the circumferential direction on the inner peripheral side of the shell plate 21 (see FIG. 2) as in the enclosed compressor 1 of the present embodiment and thus further raise the rigidity of the assembly of the compression element 3 and the mounting plate 61 serving as the fixing member including the casing 2. Thus, the operating sound attributed to the natural frequency of this assembly shifts to an even higher frequency band, and the operating sound in the frequency band around 1000 to 2000 Hz further decreases, so noise can be reduced even more.

It will be noted that, from the standpoint of the action that ensures that the distance between the welding portions 25 and the fastening bolts 62 becomes as short as possible, the number of the welding portions 25 (six in the present embodiment) is not limited to the same number as the number of the fastening bolts 62 (six in the present embodiment); for example, when the number of the fastening bolts 62 is six like in the present embodiment, the number of the welding portions 25 may be made four and the circumferential direction positions of the welding portions 25 may be disposed such that they invariably substantially coincide with the circumferential direction positions of the fastening bolts 62, such as causing the circumferential direction position of each welding portion 25 to substantially coincide with the circumferential direction position of any of the six fastening bolts 62.

Moreover, in the enclosed compressor of the conventional structure, no special consideration was given in regard to the circumferential direction positions of the fastening bolts, but the inventors of the enclosed compressor 1 of the present embodiment focused on raising the rigidity of the assembly of the compression element and the fixing member including the casing and further discovered that the circumferential direction positions of the fastening bolts affect the rigidity of the assembly of the compression element and the fixing member including the casing.

Thus, the inventors ensure that the effect of raising rigidity can be reliably obtained because the rigidity of the assembly of the compression element 3 and the mounting plate 61 serving as the fixing member including the casing 2 becomes equalized in the circumferential direction by disposing the fastening bolts 62 substantially equidistantly in the circumferential direction of the shell plate 21 (see FIG. 2) as in the enclosed compressor 1 of the present embodiment.

(C)

Further, when employing a structure where the cylinder of the compression mechanism is configured as a result of a first cover body (e.g. the front head in the enclosed compressor of the conventional structure and the present embodiment), a cylinder body and a second cover body (e.g., the rear head in the enclosed compressor of the conventional structure and the present embodiment) being juxtaposed in the axial direction of the shell plate, when employing a structure where, as in the enclosed compressor of the conventional structure, the fixing member (the mounting plate 61 in the present embodiment) is disposed so as to surmount the first cover body from the axial direction cylinder body side and where fastening bolts are screwed from the axial direction cylinder body side to fix the fixing member to the first cover body, there arises the need to avoid interference between the head portions of the fastening bolts and the cylinder body (e.g., the radial direction projecting portion 45 that is the portion in which the intake passage 38 and the bush hole 39 are formed in the present embodiment).

Here, if the number of the fastening bolts is three as in the enclosed compressor of the conventional structure, it is possible to avoid interference with the cylinder body, but when the number of the fastening bolts becomes six (or more) as in the enclosed compressor 1 of the present embodiment, it becomes difficult to avoid interference between the head portions of the fastening bolts and the cylinder body, and thus it becomes difficult to make the number of the fastening bolts six or more. In particular, it becomes extremely difficult to dispose the fastening bolts 62 substantially equidistantly in the circumferential direction of the shell plate 21 as in the enclosed compressor 1 of the present embodiment.

Thus, the inventors ensure that it becomes easy to avoid interference between the head portions 62*a* of the fastening bolts 62 and the cylinder body 33 even if the number of the fastening bolts 62 becomes six (or more) by employing a structure where the mounting plate 61 is fixed to the front head 34 serving as the first cover body by disposing the mounting plate 61 serving as the fixing member so as to surmount the cylinder 31 from the axial direction first cover body side (that is, the axial direction front head 34 side) and screwing the fastening bolts 62 from the axial direction fixing member side (that is, the axial direction mounting plate 61 side). Thus, when employing a structure where the cylinder 31 of the compression element 3 is configured as a result of the front head 34 serving as the first cover body, the cylinder body 33 and the rear head 35 serving as the second cover body being juxtaposed in the axial direction of the shell plate 21, the compression element 3 and the mounting plate 61 serving as the fixing member can be fastened and fixed together by the six (or more) fastening bolts 62.

(D)

Further, in the enclosed compressor 1 having a structure where, as in the present embodiment, the compression element 3 is fixed to the mounting plate 61 serving as the fixing member and where the mounting plate 61 is welded and fixed to the shell plate 21 of the casing 2, in the case of a large casing where an inner diameter D of the shell plate 21 (see FIG. 3) is 125 mm or more, there is a tendency for the noise level to become large in comparison to a small casing, but noise can be reduced by employing the structure described above as in the enclosed compressor 1 of the present embodiment, so the tendency for the noise level to become large as a result of enlarging the inner diameter D of the shell plate 21 can also be controlled.

(E)

Further, when carbon dioxide is used as the working fluid as in the present embodiment, it becomes easier for the compression element 3 to be vibrated by a pressure load and there is a tendency for the noise level to become large in comparison to when a HFC (hydrofluorocarbon) refrigerant or the like is used, but noise can be reduced by employing the structure described above as in the enclosed compressor 1 of the present embodiment, so the tendency for the noise level to become large as a result of using carbon dioxide as the working fluid can also be controlled.

(3) Other Embodiments

An embodiment of the present invention has been described above on the basis of the drawings, but the specific configurations thereof are not limited to this embodiment and are alterable in a scope that does not depart from the gist of the invention.

For example, in the preceding embodiment, the present invention is applied with respect to a configuration having the single compression chamber 37 sectioned and formed by the front head 34 serving as the first cover body, the cylinder body 33 and the rear head 35 serving as the second cover body, but the present invention is not limited to this and is also applicable to a configuration where plural compression chambers are formed by plurally dividing the cylinder body in the axial direction with a middle head.

INDUSTRIAL APPLICABILITY

By utilizing the present invention, noise can be reduced in an enclosed compressor having a structure where a compression element is fixed to a fixing member and where the fixing member is welded and fixed to a shell plate of a casing.

What is claimed is:

1. An enclosed compressor comprising:

a compression element configured to compress a working fluid;

a casing housing the compression element and having a substantially cylindrical shell plate; and a fixing member welded to the shell plate, the compression element being fixed to the fixing member by at least six fastening bolts, the compression element including a front head, a cylinder body and a rear head arranged along an axial direction of the shell plate to form a cylinder of the compression element, and the fixing member being arranged on a front head side of the cylinder and being directly fixed to the front head by screwing the fastening bolts from the axial direction on a fixing member side of the front head.

2. The enclosed compressor according to claim 1, wherein the fixing member contacts an inner peripheral surface of the shell plate and is welded to the shell plate at a plurality of welding portions that are arranged along a circumferential direction of the shell plate, the fastening bolts being are arranged along the circumferential direction of the shell plate and disposed on an inner peripheral side of the shell plate, and circumferential positions of the welding portions substantially coincide with circumferential positions of the fastening bolts.

3. The enclosed compressor according to claim 2, wherein the fastening bolts are disposed substantially equidistantly from each other about the circumferential direction of the shell plate.

4. The enclosed compressor according to claim 2, wherein an inner diameter of the shell plate is at least 125 millimeters.

5. The enclosed compressor according to claim 2, wherein the working fluid is carbon dioxide.

6. The enclosed compressor according to claim 1, wherein the working fluid is carbon dioxide.

7. The enclosed compressor according to claim 3, wherein an inner diameter of the shell plate is at least 125 millimeters.

8. The enclosed compressor according to claim 3, wherein the working fluid is carbon dioxide.

9. The enclosed compressor according to claim 1, wherein an inner diameter of the shell plate is at least 125 millimeters.

10. The enclosed compressor according to claim 9, wherein the working fluid is carbon dioxide.

11. The enclosed compressor according to claim 4, wherein the working fluid is carbon dioxide.

12. The enclosed compressor according to claim 1, wherein the fastening bolts are disposed substantially equidistantly from each other about the circumferential direction of the shell plate.

* * * * *